US007381037B2

(12) United States Patent
Kim et al.

(10) Patent No.: US 7,381,037 B2
(45) Date of Patent: Jun. 3, 2008

(54) APPARATUS FOR VARYING CAPACITY OF SCROLL COMPRESSOR

(75) Inventors: Cheol-Hwan Kim, Seoul (KR); Dong-Koo Shin, Anyang (KR); Hyo-Keun Park, Suwon (KR); Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/034,776

(22) Filed: Jan. 14, 2005

(65) Prior Publication Data

US 2006/0093504 A1 May 4, 2006

(30) Foreign Application Priority Data

Nov. 4, 2004 (KR) ..... 10-2004-0089395

(51) Int. Cl.
*F01C 1/02* (2006.01)
*F04C 2/00* (2006.01)

(52) U.S. Cl. ..... 418/55.1; 418/55.5; 418/57; 418/270; 417/310; 417/410.5

(58) Field of Classification Search ..... 418/55.1–55.6, 418/57, 270; 417/307, 308, 310, 410.5
See application file for complete search history.

(56) References Cited

U.S. PATENT DOCUMENTS

| | | | | |
|---|---|---|---|---|
| 4,846,633 | A | 7/1989 | Suzuki et al. | |
| 5,336,058 | A * | 8/1994 | Yokoyama | 418/55.1 |
| 5,551,846 | A * | 9/1996 | Taylor et al. | 418/55.1 |
| 5,803,716 | A | 9/1998 | Wallis et al. | |
| 6,095,765 | A | 8/2000 | Khalifa | |
| 6,213,731 | B1 | 4/2001 | Doepker et al. | |
| 6,299,417 | B1 | 10/2001 | Shin et al. | |
| 2005/0019176 | A1 | 1/2005 | Shin et al. | |

FOREIGN PATENT DOCUMENTS

| | | |
|---|---|---|
| CN | 1094566 | 11/2002 |
| DE | 37 39 978 A1 | 6/1988 |
| DE | 195 20 757 A1 | 12/1995 |
| DE | 102 40 980 A1 | 4/2003 |
| EP | 1 158 167 A1 | 11/2001 |

(Continued)

*Primary Examiner*—Theresa Trieu
(74) *Attorney, Agent, or Firm*—Birch, Stewart, Kolasch & Birch, LLP

(57) ABSTRACT

An apparatus for varying the capacity of a scroll compressor is disclosed. The apparatus for varying the capacity of a scroll compressor includes a bypass passage for connecting a compression pocket under intermediate pressure among compression pockets formed by a wrap of a fixed scroll and a wrap of a orbiting scroll and a suction side through which refrigerant is inhaled into the compression pocket to each other, an opening and closing device for opening and closing the bypass passage, and an elastic opening and closing device mounted in the bypass passage to open and close the bypass passage by the pressure of the compression pocket and the pressure and elasticity of the suction side according as the bypass passage is opened and closed by the opening and closing device. Therefore, it is possible to simplify the structure of varying the capacity of a compressor such that it is possible to reduce the size of the apparatus for varying the capacity of a scroll compressor and to thus reduce the number of parts.

7 Claims, 6 Drawing Sheets

FOREIGN PATENT DOCUMENTS

| | | | | | |
|---|---|---|---|---|---|
| JP | 58-220988 | A | | 12/1983 | |
| JP | 60075796 | A | | 4/1985 | |
| JP | 60075796 | A | * | 4/1985 | |
| JP | 02-271094 | A | | 11/1990 | |
| JP | 2271094 | A | | 11/1990 | |
| JP | 3-294687 | A | | 12/1991 | |
| JP | 04121481 | A | * | 4/1992 | ..... 418/55.6 |
| JP | 2000-329078 | A | | 11/2000 | |
| JP | 2000329078 | A | * | 11/2000 | |
| KR | 2004091362 | A | * | 10/2004 | |

* cited by examiner

APPARATUS FOR VARYING CAPACITY OF SCROLL COMPRESSOR

BACKGROUND OF THE INVENTION

1. Field of the Invention

The present invention relates to a scroll compressor, and more particularly, to an apparatus for varying the capacity of a scroll compressor in which a structure for varying the capacity of a compressor is simplified to reduce the size of the apparatus for varying the capacity of a scroll compressor and to reduce the number of parts.

2. Description of the Background Art

In general, a compressor converts electric energy into kinetic energy that compresses a refrigerant gas. The compressor is a core element that constitutes a freezing cycle system and is divided into various kinds such as a rotary compressor, a scroll compressor, and a reciprocal compressor in accordance with compression mechanism by which refrigerant is compressed. Compressors are used for refrigerators, air conditioners, and show cases.

FIG. 1 is a sectional view illustrating a compressing device of the scroll compressor. FIG. 2 is a plan view illustrating a wrap of a fixed scroll and a wrap of a orbiting scroll that constitutes the compressing device.

As illustrated in the drawings, the compressing device of the scroll compressor includes a fixed scroll 30 mounted in a sealed container 10 so as to be separated from an upper frame 20 mounted in the sealed container 10 by a predetermined distance, a orbiting scroll 40 positioned between the fixed scroll 30 and the upper frame 20 so as to be interlocked with the fixed scroll 30, an Oldham's ring 50 positioned between the orbiting scroll 40 and the upper frame 20 to preventing the rotation of the orbiting scroll 40, a high and low pressure dividing plate 11 combined with the fixed scroll 30 and the sealed container 10 to divide the inside of the sealed container 10 into a high pressure region and a low pressure region, and a discharge valve assembly 60 mounted on the top surface of the fixed scroll 30 to open and close a discharge hole 31 formed in the fixed scroll 30. The orbiting scroll 40 is connected to an eccentric portion 71 of a rotating shaft 70 inserted into the upper frame 20.

A suction pipe 12 into which a gas is inhaled is combined with one side of the sealed container 10 positioned in the low pressure region. A discharge pipe 13 through which a gas is discharged is combined with one side of the sealed container 10 positioned in the high pressure region.

Reference numeral 32 denotes the wrap of the fixed scroll 30 that protrudes in the form of an involute curve. Reference numeral 41 denotes the wrap of the orbiting scroll 40 that protrudes in the form of an involute curve. B denotes bushes. S denotes a sealing member.

The operation of the compressing device of the above-described scroll compressor is as follows.

First, when the rotary force of an electric motor is transmitted to rotate the rotating shaft 70, the orbiting scroll 40 combined with the eccentric portion 71 of the rotating shaft pivots based on the rotating shaft 70. The orbiting scroll 40 pivots in a state where the rotation of the orbiting scroll 40 is prevented by the Oldham's ring 50.

According as the orbiting scroll 40 pivots, the wrap 41 of the orbiting scroll 40 pivots while being engaged with the wrap 32 of the fixed scroll 30 such that a plurality of compression pockets P formed by the wrap 41 of the orbiting scroll 40 and the wrap 32 of the fixed scroll 30 move to the centers of the fixed scroll 30 and the orbiting scroll 40 and that volume changes at the same time. Therefore, a gas is inhaled and compressed and then, is discharged through the discharge hole 31 of the fixed scroll 30.

The high temperature and high pressure gas discharged through the discharge hole 31 of the fixed scroll 30 passes through the high pressure region and is discharged to the outside of the sealed container 10 through the discharge pipe 13.

On the other hand, the above-described scroll compressor commonly constitutes a freezing cycle system to be mainly mounted in air conditioners. In order to minimize power consumption during the operation of an air conditioner, it is necessary to vary the capacity of a scroll compressor that drives the freezing cycle system mounted in the air conditioner.

FIG. 3 is a sectional view illustrating the compressing device of the scroll compressor that includes an example of the conventional apparatus for varying the capacity of a scroll compressor. The same members are denoted by the same reference numerals.

As illustrated in the drawing, the structure of the conventional apparatus for varying the capacity of a scroll compressor is as follows.

A bypass passage K for connecting intermediate pressure compression pockets P under intermediate pressure positioned in the middle of the fixed scroll 30 among the compression pockets P formed by the wrap 32 of the fixed scroll and the wrap 41 of the orbiting scroll to a suction side through which refrigerant is inhaled into the compression pockets P is formed in the fixed scroll 30. The bypass passage K includes a horizontal hole 33 formed so as to be horizontal to the fixed scroll 30, a vertical hole 34 formed so as to be vertical to the fixed scroll 30 and connected to the horizontal hole 33, and a connection hole 35 formed so as to be connected to the top surface of the fixed scroll 30 in the portion where the horizontal hole 33 and the vertical hole 34 are connected to each other. A through hole in which the connection hole 35 and a high pressure chamber are connected to each other is formed in the high and low pressure dividing plate 11.

A first connection pipe 14 for connecting the suction pipe 12 and the discharge pipe 13 to each other is connected between the suction pipe 12 and the discharge pipe 13. A second connection pipe 15 for connecting the first connection pipe 14 and the bypass passage K to each other is connected between the first connection pipe 14 and the bypass passage K. One side of the second connection pipe 15 is combined with the side of the connection hole 35 of the bypass passage K.

A control valve 16 for controlling the direction of the flow of the refrigerant that flows through the first and second connection pipes 14 and 15 is provided in the portion where the first connection pipe 14 and the second connection pipe 15 are connected to each other. A bypass valve 17 for controlling the flow of the refrigerant is provided in the connection hole 35 of the bypass passage K.

The operation of the above-described apparatus for varying the capacity of a scroll compressor will be described as follows.

First, when the scroll compressor is operated at the capacity of 100%, the control valve 16 is positioned such that the second connection pipe 15 and the discharge pipe 13 are connected to each other. When the scroll compressor is operated in the above-described state, since the discharge pipe 13 and the second connection pipe 15 are connected to each other, the bypass valve 17 positioned in the connection hole 35 is pressed by the high pressure refrigerant discharged to the discharge pipe 13 such that the bypass valve 17 is positioned under the connection hole 35 to close the horizontal hole 33 and the vertical hole 34. Therefore, the bypass passage K for connecting the suction side through which the refrigerant is inhaled into the compression pockets P and the compression pockets P under intermediate pressure to each other is closed.

In such a state, the plurality of compression pockets P formed at the edge of the fixed scroll 30 by the wrap 41 of the orbiting scroll and the wrap 32 of the fixed scroll due to the pivoting motion of the orbiting scroll 40 move toward the center of the fixed scroll 30 and, at the same time, volume is reduced such that the refrigerant is compressed. The compression pockets P are continuously formed.

When the scroll compressor is operated at variable capacity, the control valve 16 is moved to connect the second connection pipe 15 and the suction pipe 12 to each other. When the scroll compressor is operated in such a state, since the suction pipe 12 and the second connection pipe 15 are connected to each other, the bypass valve 17 moves to the upper side of the connection hole 35 due to the pressure of the compression pockets P under intermediate pressure applied to the bypass valve 17 such that the bypass passage K is opened. According as the bypass passage K is opened, the pressure of the suction side through which the refrigerant is inhaled into the compression pockets P is equal to the pressure of the compression pockets P in the middle of the fixed scroll 30. Therefore, the compression pockets P positioned in the middle of the fixed scroll 30 move to the center of the fixed scroll 30 and, at the same time volume is reduced such that refrigerant is compressed. Therefore, the pressure of the refrigerant discharged through the discharge hole 31 of the fixed scroll is relatively low.

However, according to the above-described conventional apparatus for varying the capacity of a scroll compressor, since the suction pipe 12 and the discharge pipe 13 are connected to each other by the first connection pipe 14 and the first connection pipe 14 is connected to the second connection pipe 15, the entire structure is complicated and the size of the scroll compressor increases. Therefore, the scroll compressor occupies a large space in an air conditioner and cannot be freely installed in the air conditioner.

SUMMARY OF THE INVENTION

In order to solve the above-described problems, it is an object of the present invention to provide an apparatus for varying the capacity of a scroll compressor in which a structure of varying the capacity of a compressor is simplified to reduce the size of the apparatus for varying the capacity of a scroll compressor and to thus reduce the number of parts.

It is another object of the present invention to provide an apparatus for varying the capacity of a scroll compressor capable of minimizing loss during the operation of varying capacity.

In order to achieve the above objects, there is provided an apparatus for varying the capacity of a scroll compressor comprising a bypass passage for connecting a compression pocket under intermediate pressure among compression pockets formed by a wrap of a fixed scroll and a wrap of a orbiting scroll and a suction side through which refrigerant is inhaled into the compression pocket to each other, an opening and closing device for opening and closing the bypass passage, and an elastic opening and closing device mounted in the bypass passage to open and close the bypass passage by the pressure of the compression pocket and the pressure and elasticity of the suction side according as the bypass passage is opened and closed by the opening and closing device.

An apparatus for varying the capacity of a scroll compressor comprises a bypass passage for connecting a compression pocket formed by a wrap of a fixed scroll and a wrap of a orbiting scroll and a suction side through which refrigerant is inhaled into the compression pocket to each other and an opening and closing device for opening and closing the bypass passage.

BRIEF DESCRIPTION OF THE DRAWINGS

The accompanying drawings are included to provide a further understanding of the invention, and are incorporated in and constitute a part of this specification. The drawings illustrate example embodiments of the present invention and, together with the description, serve to explain principles of the present invention. In the drawings.

DETAILED DESCRIPTION OF THE PREFERRED EMBODIMENTS

Hereinafter, an apparatus for varying the capacity of a scroll compressor according to the present invention will be described in detailed with reference to the attached drawings.

Figure 1:
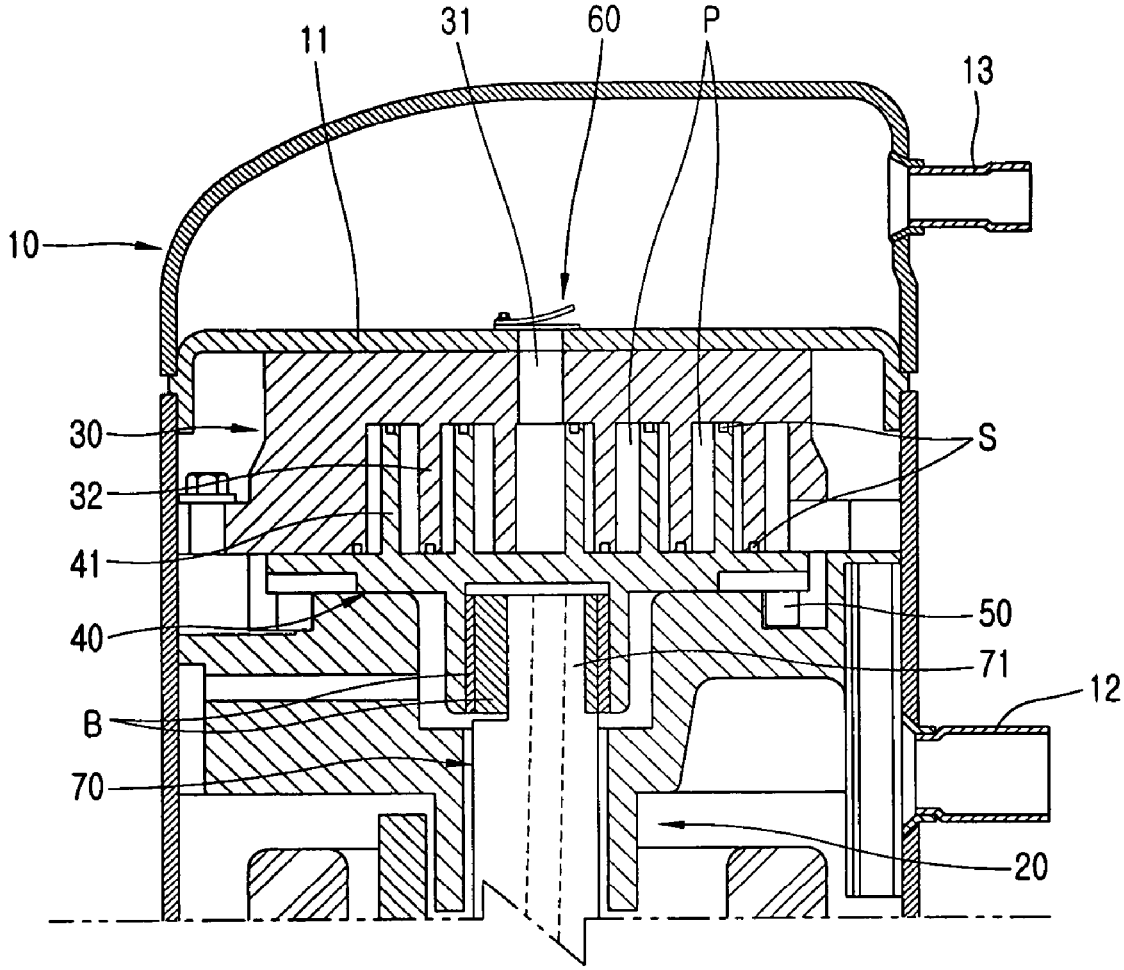
FIG. 1 CONVENTIONAL ART
FIG. 1 is a sectional view illustrating a compressing device of a common scroll compressor.
Figure 2:
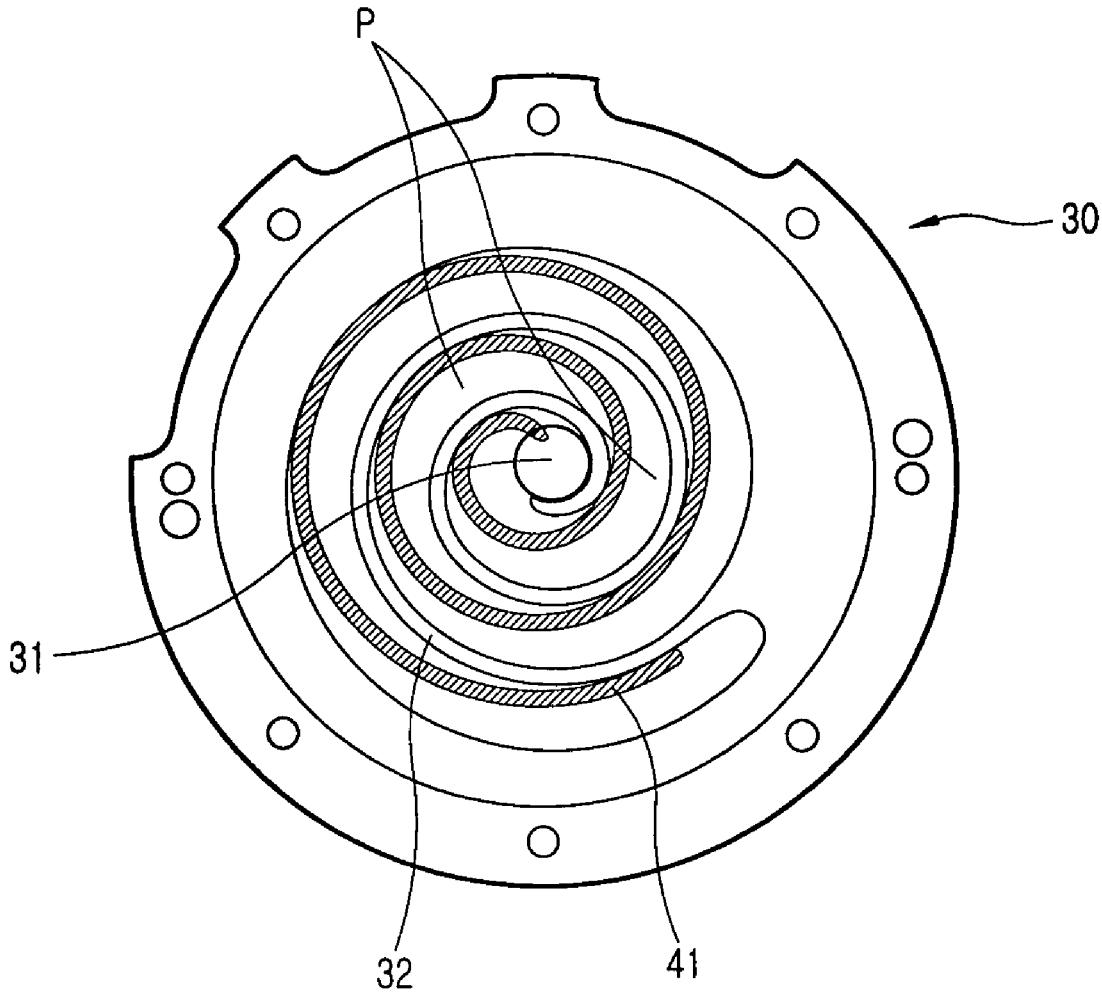
FIG. 2 CONVENTIONAL ART
FIG. 2 is a plan view illustrating a fixed scroll wrap and a orbiting scroll wrap that constitute the compressing device of the scroll compressor.
Figure 3:
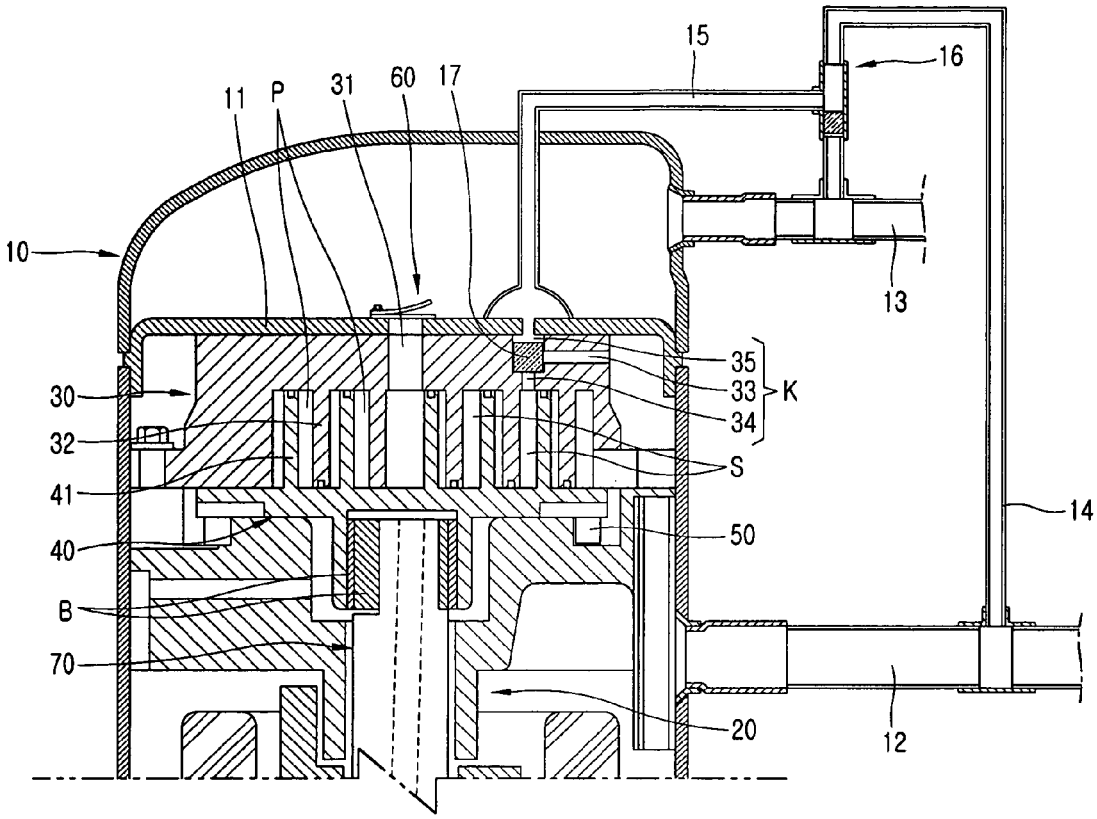
FIG. 3 CONVENTIONAL ART
FIG. 3 is a sectional view illustrating a compressing device of a scroll compressor that includes a conventional apparatus for varying the capacity of a scroll compressor.
Figure 4:
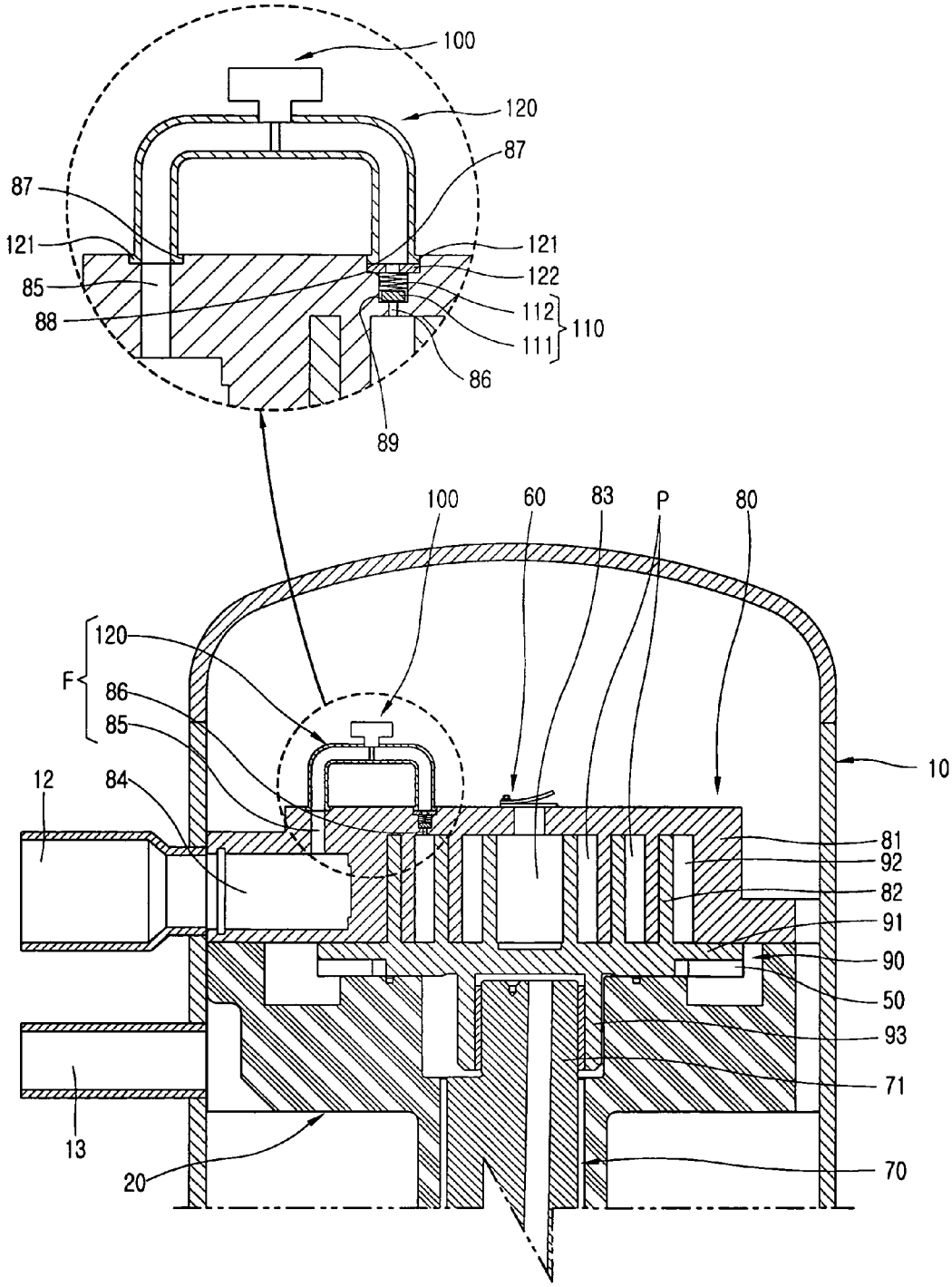
FIG. 4 is a sectional view illustrating a compressing device of a scroll compressor that includes an apparatus for varying the capacity of a scroll compressor according to a first embodiment of the present invention.

FIG. 4 is a sectional view illustrating a compressing device of a scroll compressor that includes an apparatus for varying the capacity of a scroll compressor according to a first embodiment of the present invention.

As illustrated in FIG. 4, the structure of the compressing device of the scroll compressor is as follows. A fixed scroll 80 is mounted in a sealed container 10 having a predetermined shape to be separated from an upper frame 20 mounted in the sealed container 10 by a predetermined distance. A orbiting scroll 90 is positioned between the fixed scroll 80 and the upper frame 20 so as to be pivotably engaged with the fixed scroll 80.

In the fixed scroll 80, an involute curve-shaped wrap 82 having predetermined thickness and height is formed on one surface of a predetermined shaped body 81, a discharge hole 83 is formed in the middle of the body 81, and a suction hole 84 is formed in one side of the body 81.

In the orbiting scroll 90, an involute curve-shaped wrap 92 having predetermined thickness and height is formed on one surface of a disk 91 and a boss 93 is formed on the other surface of the disk 91.

The orbiting scroll 90 is inserted between the upper frame 20 and the fixed scroll 80 such that the wrap 92 is engaged with the wrap 82 of the fixed scroll. When the orbiting scroll 90 pivots, a plurality of compression pockets P are continuously formed by the wrap 92 of the orbiting scroll and the wrap 82 of the fixed scroll. At this time, the compression pockets P positioned at the edge of the fixed scroll 80 are under suction pressure that is low pressure. The compression pockets P in the middle of the fixed scroll 80 are under discharge pressure that is high pressure. The compression pockets P positioned between the edge and the middle of the fixed scroll 80 are under intermediate pressure. The orbiting scroll 90 is supported by the top surface of the upper frame 20.

An Oldham's ring 50 for preventing the rotation of the orbiting scroll 90 is combined between the orbiting scroll 90 and the upper frame 20. A discharge valve assembly 60 for opening and closing the discharge hole 83 of the fixed scroll 80 is provided on the top surface of the fixed scroll 80.

The boss 93 of the orbiting scroll is connected to an eccentric portion 71 of a rotating shaft 70 inserted into the upper frame 20.

A suction pipe 12 through which a gas is inhaled is combined with the sealed container 10 and the suction pipe 12 is combined with the suction hole 84 of the fixed scroll. A discharge pipe 13 through which a gas is discharged is combined with the sealed container 10.

An apparatus for varying capacity is provided in the side of the fixed scroll 80.

An apparatus for varying the capacity of a scroll compressor according to a first embodiment of the present invention includes a bypass passage F for connecting the compression pockets P under intermediate pressure among the compression pockets P formed by the wrap 82 of the fixed scroll and the wrap 92 of the orbiting scroll and the suction side through which refrigerant is inhaled into the compression pockets P to each other, opening and closing device 100 for opening and closing the bypass passage F, and elastic opening and closing device 110 mounted in the bypass passage F to open and close the bypass passage F by the pressure of the compression pockets P, the pressure of the suction side, and the elasticity thereof according as the opening and closing device 100 opens and closes the bypass passage F.

The bypass passage F includes a first hole 85 formed in the body 81 of the fixed scroll to connect the suction side of the fixed scroll 80 and the top surface of the fixed scroll 80 to each other, a second hole 86 formed in the body 81 of the fixed scroll to connect the compression pockets P under the intermediate pressure and the top surface of the fixed scroll 80 to each other, and a connection pipe 120 positioned on the top surface of the fixed scroll 80 to connect the first hole 85 and the second hole 86 to each other. The first hole 85 is formed so as to be vertical to the second hole 86.

The opening and closing device 100 is provided in the connection pipe 120. The opening and closing device 100 is preferably an opening and closing valve for opening and closing the connection pipe 120.

The connection pipe 120 is bent and has flanges 121 in both ends, respectively. Combination grooves 87 having a shape corresponding to the flanges 121 and predetermined depth are formed on the top surface of the fixed scroll 80. The combination grooves 87 are formed at the edges of the first hole 85 and the second hole 86, respectively.

The flanges 121 of the connection pipe are inserted into the combination grooves 87 formed at the edges of the first hole 85 and the second hole 86 and screws (not shown) are fastened to the flanges 121, respectively. Packings 122 are preferably inserted between the flanges 121 and the bottom surfaces of the combination grooves 87.

An insertion space 88 is provided in the second hole 86 to have an inside diameter larger than the inside diameter of the second hole 86 and predetermined length such that the elastic opening and closing device 100 is mounted therein. A step difference 89 is formed such that the portion in which the second hole 86 and the insertion space 88 are connected to each other is vertical to the external circumference of the second hole 86.

The elastic opening and closing device 110 includes a rod-shaped piston valve 111 movably inserted into the insertion space 88 of the second hole 86 to open and close the second hole 86 and a spring 112 inserted into the insertion space 88 to elastically support the piston valve 111. The outside diameter of the piston valve 111 is smaller than the inside diameter of the insertion space 88 and is larger than the inside diameter of the second hole 86.

The piston valve 111 is inserted into the insertion space 88 and the spring 112 is inserted onto the piston valve 111. The spring 112 is supported by an additional member.

Figure 5:
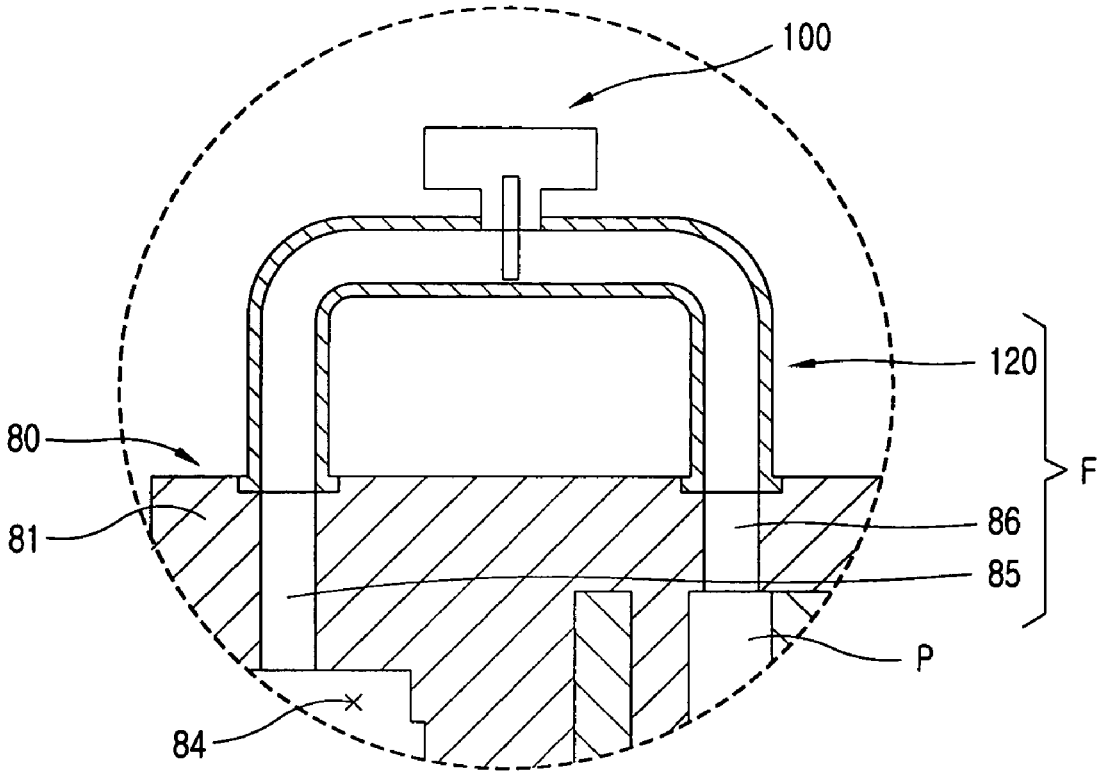
FIG. 5 is a sectional view illustrating an apparatus for varying the capacity of a scroll compressor according to a second embodiment of the present invention.

An apparatus for varying the capacity of a scroll compressor according to a second embodiment of the present invention includes the bypass passage F for connecting the compression pockets P under intermediate pressure formed by the wrap 82 of the fixed scroll and the wrap 92 of the orbiting scroll and the suction side through which refrigerant is inhaled into the compression pockets P to each other and the opening and closing device 100 for opening and closing the bypass passage F as illustrated in FIG. 5.

The bypass passage F includes the first hole 85 formed in the fixed scroll 80 to connect the suction side of the fixed scroll 80 and the top surface of the fixed scroll 80 to each other, the second hole 86 formed in the fixed scroll 80 to connect the compression pockets P under intermediate pressure and the top surface of the fixed scroll 80 to each other, and the connection pipe 120 for connecting the first hole 85 and the second hole 86 to each other.

The opening and closing device 100 is mounted in the connection pipe 120. The opening and closing device 100 is preferably formed of an opening and closing valve for opening and closing the connection pipe 120.

On the other hand, as a modification of the bypass passage F, a connection hole for connecting the compression pockets P and the suction hole to the body 81 of the fixed scroll may be formed.

Hereinafter, the operation and the effect of the apparatus for varying the capacity of a scroll compressor according to the present invention will be described as follows.

First, the operation of the compressing device of the scroll compressor is as follows.

When the rotary force of an electric motor is transmitted to the orbiting scroll 90 through the rotating shaft 70, the orbiting scroll 90 pivots based on the center of the rotating shaft 70 while being engaged with the fixed scroll 80. The orbiting scroll 90 pivots in a state where the rotation of the orbiting scroll 90 is prevented by the Oldham's ring 50.

According as the orbiting scroll 90 pivots, the wrap 92 of the orbiting scroll pivots while being engaged with the wrap 82 of the fixed scroll such that a plurality of compression pockets P formed by the wrap 92 of the orbiting scroll and the wrap 82 of the fixed scroll move to the center of the fixed scroll 80 and that volume changes at the same time. Therefore, a gas is inhaled and compressed and then, is discharged through the discharge hole 31 of the fixed scroll. At this time, the refrigerant inhaled through the suction pipe 12 is directly received to the compression pockets P through the suction hole 84 of the fixed scroll. The compression pockets P are continuously formed according as the orbiting scroll 90 pivots.

In a state where the compression pockets P are positioned at the edge of the fixed scroll 80, the pressure of the compression pockets P is the suction pressure that is low pressure such that the compression pockets P move to the center of the fixed scroll 80 in a state where the volume of the compression pockets P is reduced. In a state where the compression pockets P are positioned in the center of the fixed scroll 80, the pressure of the compression pockets P is the discharge pressure that is high pressure. In a state where the compression pockets P are positioned between the center and the edge of the fixed scroll 80, the pressure of the compression pockets P is intermediate pressure.

The high temperature and high pressure refrigerant discharged through the discharge hole 83 of the fixed scroll passes through the sealed container and is discharged to the outside through the discharge pipe 13. The inside of the sealed container 10 is always under high pressure. Due to the high pressure inside the sealed container 10, high pressure is applied to the rear surface of the disk 91 of the orbiting scroll such that it is possible to prevent pressure from leaking between the compression pockets P formed by the wrap 92 of the orbiting scroll and the wrap 82 of the fixed scroll.

On the other hand, when the scroll compressor is operated at the capacity of 100% in the above-described processes (in the case of the apparatus for varying the capacity of a scroll compressor according to the first embodiment), as illustrated in FIG. 4, the opening and closing device 100 closes the bypass passage F. That is, the opening and closing device 100 closes the connection pipe 120 that constitutes the bypass passage F. When the scroll compressor is operated in such a state, a spring elastically supports the piston valve 111 such that the piston valve 111 closes the second hole 86 of the bypass passage F. Therefore, the compression pockets P positioned at the edge of the fixed scroll 80 move to the center of the fixed scroll 80 such that the refrigerant inhaled into the compression pockets P is compressed to be at high temperature and under high pressure.

Figure 6:
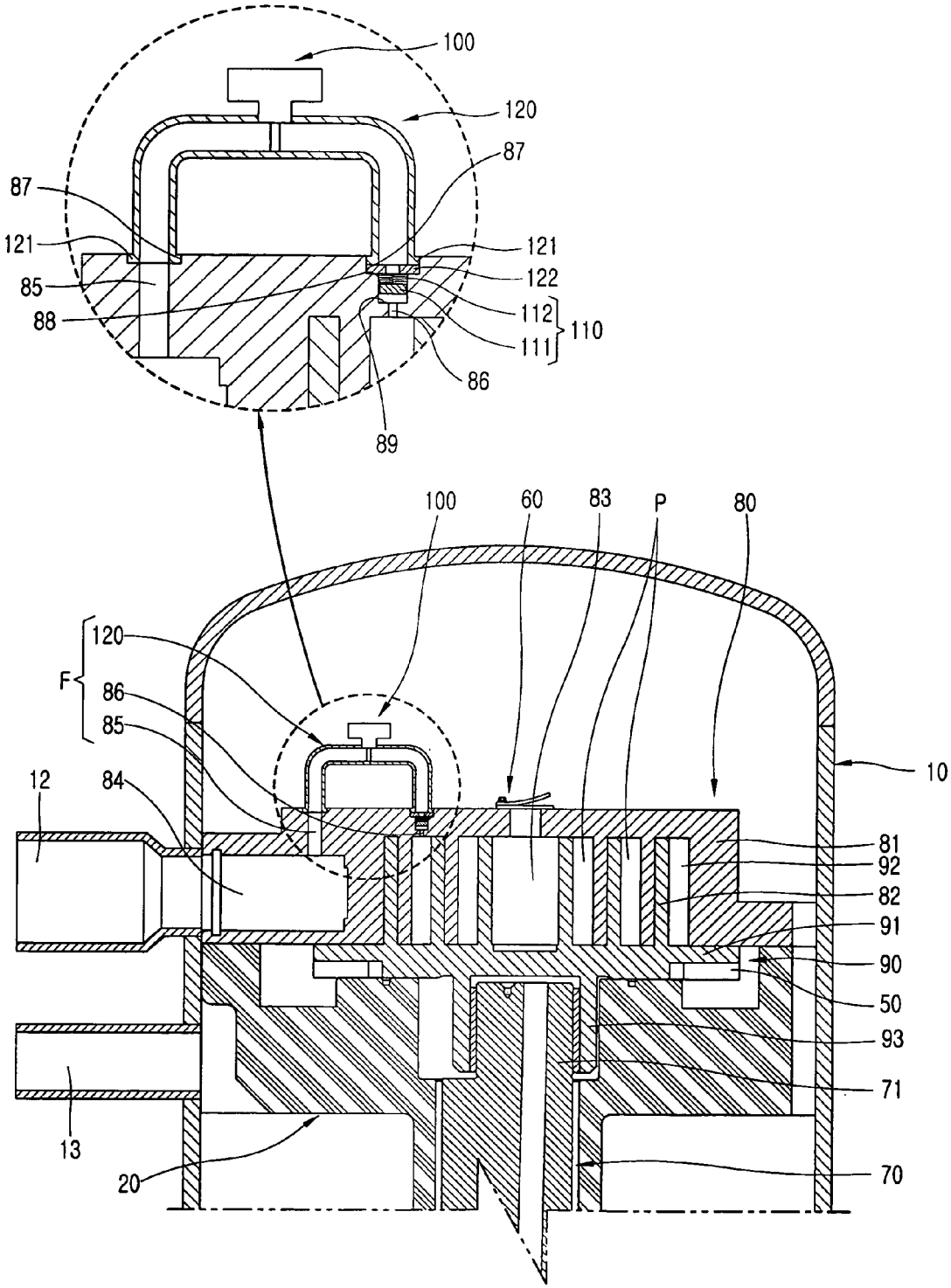
FIG. 6 is a sectional view illustrating a state in which the apparatus for varying the capacity of a scroll compressor according to the present invention operates.

On the other hand, when the scroll compressor is operated at variable capacity, as illustrated in FIG. 6, the opening and closing device 100 is operated to open the bypass passage F. When the scroll compressor is operated in such a state, the pressure of the compression pockets P under the intermediate pressure is higher than the pressure of the suction hole 84 such that the spring 112 of the elastic opening and closing device is contracted due to the pressure difference and that the piston valve opens the second hole 86. Therefore, the compression pockets P under the intermediate pressure and the suction hole 84 are connected to each other such that the compression pockets P under the intermediate pressure are under the suction pressure that is the low pressure. As described above, the pressure of the compression pockets P positioned between the center and the edge of the fixed scroll 80 is the suction pressure that is the low pressure and the compression pockets P move to the center of the fixed scroll 80 such that the refrigerant is compressed and is discharged through the discharge hole 83. Therefore, the pressure of the refrigerant discharged through the discharge hole 83 is reduced and the capacity of the scroll compressor is reduced.

Also, in the case of the apparatus for varying the capacity of a scroll compressor according to the second embodiment of the present invention, the bypass passage F for connecting the suction side and the compression pockets P under the intermediate pressure to each other is opened and closed by the opening and closing device 100. Therefore, the capacity of the scroll compressor is varied.

Also, according to the apparatus for varying the capacity of a scroll compressor according to the present invention, as described above, when the sealed container is always under high pressure and sealing is performed between the compression pockets P due to the high pressure, additional sealing members are not inserted into the end of the wrap 92 of the orbiting scroll and the end of the wrap 82 of the fixed scroll such that it is possible to make the second hole 86 that constitutes the bypass passage F relatively large. Therefore, it is possible to reduce the flow resistance of the refrigerant that flows through the second hole 86.

As described above, since the apparatus for varying the capacity of a scroll compressor according to the present invention consists of the opening and closing device, the bypass passage, and the elastic opening and closing device and the parts thereof are positioned in the sealed container, the number of parts is reduced and the entire size of the apparatus for varying the capacity of a scroll compressor is reduced such that it is possible to reduce the space occupied by the apparatus for varying the capacity of a scroll compressor in an air conditioner and to freely install the apparatus in the air conditioner. Also, it is possible to reduce manufacturing cost and to easily manufacture the apparatus for varying the capacity of a scroll compressor.

Also, according to the scroll compressor to which the present invention is applied, the size of the second hole that constitutes the bypass passage is increased such that the flow resistance of the refrigerant is reduced. Therefore, it is possible to minimize the loss of the refrigerant.

What is claimed is:

1. An apparatus for varying the capacity of a scroll compressor having a container, a fixed scroll located within the container, and a discharge space being located between the fixed scroll and the container, the apparatus comprising:

a bypass passage for connecting a compression pocket under intermediate pressure among compression pockets formed by a wrap of the fixed scroll and a wrap of a orbiting scroll and a suction side through which refrigerant is inhaled into the compression pockets to each other, a portion of the bypass passage being a connecting member passage located in a connection member connecting the compression pocket under intermediate pressure to the suction side, the connection member being separate from the container and extending into the discharge space;

an opening and closing device for opening and closing the bypass passage; and an elastic opening and closing device mounted in the bypass passage to open and close the bypass passage by the pressure of the compression pocket and the pressure of the suction side as the bypass passage is opened and closed by the opening and closing device, wherein the bypass passage includes:

a first hole formed in the fixed scroll to connect the suction side of the fixed scroll and the top surface of the fixed scroll to each other;

a second hole formed in the fixed scroll to connect the compression pocket under intermediate pressure and the top surface of the fixed scroll to each other; and the connection member being a connection pipe for connecting the first hole and the second hole to each other, wherein an insertion space is provided in the second hole to have an inside diameter larger than the inside diameter of the second hole and predetermined length such that the elastic opening and closing device is mounted therein, and wherein the elastic opening and closing device is mounted in the insertion space.

2. The apparatus for varying the capacity of a scroll compressor according to claim 1, wherein the opening and closing device is provided in the connection pipe.

3. The apparatus for varying the capacity of a scroll compressor according to claim 1, wherein a step difference vertical to the outer circumference of the second hole is formed in the portion where the second hole and the insertion space are connected to each other.

4. The apparatus for varying the capacity of a scroll compressor according to claim 1, wherein the elastic opening and closing device comprises:

a rod-shaped piston valve movably inserted into the insertion space to open and close the second hole; and a spring inserted into the insertion space to elastically support the piston valve.

5. The apparatus for varying the capacity of a scroll compressor according to claim 4, wherein the outside diameter of the piston valve is smaller than the inside diameter of the insertion space and is larger than the inside diameter of the second hole.

6. The apparatus for varying the capacity of a scroll compressor according to claim 1, wherein a suction hole through which a gas is inhaled into the compression pockets formed by the wrap of the fixed scroll and the wrap of the orbiting scroll is formed in the fixed scroll, and wherein a suction pipe through which refrigerant in the outside is inhaled is combined with the suction hole of the fixed scroll.

7. The apparatus for varying the capacity of a scroll compressor according to claim 1, wherein the sealing between the compression pockets formed by the wrap of the fixed scroll and the wrap of the orbiting scroll is performed by the pressure of a discharge gas applied to the rear surface of the orbiting scroll.

* * * * *